US012742314B2

(12) United States Patent
González Polo et al.

(10) Patent No.: US 12,742,314 B2
(45) Date of Patent: Sep. 22, 2026

(54) PIN FOR COUPLING BETWEEN A WEAR ELEMENT AND A SUPPORT OF AN EARTH-MOVING MACHINE AND COUPLING SYSTEM

(71) Applicant: METALOGENIA RESEARCH & TECHNOLOGIES S.L., Barcelona (ES)

(72) Inventors: Adrián González Polo, Barcelona (ES); Rubén Carballo Villazala, Cerdanyola del Valles (ES); Carles Nostrort, Castelló (ES); Francisco Pérez Soria, La Roca del Valles (ES)

(73) Assignee: METALOGENIA RESEARCH & TECHNOLOGIES S.L., Barcelona (ES)

( * ) Notice: Subject to any disclaimer, the term of this patent is extended or adjusted under 35 U.S.C. 154(b) by 320 days.

(21) Appl. No.: 18/567,135

(22) PCT Filed: Jun. 10, 2021

(86) PCT No.: PCT/ES2021/070429
§ 371 (c)(1),
(2) Date: Dec. 5, 2023

(87) PCT Pub. No.: WO2022/258855
PCT Pub. Date: Dec. 15, 2022

(65) Prior Publication Data

US 2024/0271395 A1 Aug. 15, 2024

(51) Int. Cl.
*E02F 9/28* (2006.01)

(52) U.S. Cl.
CPC ..... *E02F 9/2825* (2013.01); *E02F 9/2841* (2013.01)

(58) Field of Classification Search
None
See application file for complete search history.

(56) References Cited

U.S. PATENT DOCUMENTS

| | | | | |
|---|---|---|---|---|
| 3,019,537 | A | 2/1962 | Stephenson | |
| 4,881,331 | A | 11/1989 | Paizes | |
| 2012/0017474 | A1* | 1/2012 | Rol Corredor | E02F 9/2841 37/456 |

FOREIGN PATENT DOCUMENTS

| | | | |
|---|---|---|---|
| WO | 94/18401 | A1 | 8/1994 |
| WO | 2010/089423 | A1 | 8/2010 |
| WO | 2018/007652 | A1 | 1/2018 |

OTHER PUBLICATIONS

BASF Title:"Engineering plastics and polyurethanes": CELLESTO p. 36 Journal: BASF, Publish Date:2016 (retrieved: Jan. 2, 2026) Link: https://www.albis.com/dam/jcr:6fc61f36-75dc-4142-a350-29e6389bb86c/Engineering_plastics_E_E_automotive.pdf (Year: 2016).*

(Continued)

*Primary Examiner* — Christopher J Sebesta
*Assistant Examiner* — Alfred H Tsui
(74) *Attorney, Agent, or Firm* — Sughrue Mion, PLLC

(57) ABSTRACT

The present invention relates to a pin for coupling between a wear element and a support of an earth-moving machine and a coupling system, said system comprising a wear element, a support to receive said wear element and a pin to secure retention between the wear element and the support thereof. The female part is coupled to the male part, these two parts being kept coupled by means of the pin of the present invention which comprises a body, an elastic block and a latch that acts as a retention element. The pin that interacts with the latch that locks the pin in position. Said pin prevents the female part from coming out of the mounting position thereof with the male part and therefore keeps the (Continued)

coupling between both parts. The detachable lock enables the pin to be removed from the coupling.

11 Claims, 6 Drawing Sheets

(56) References Cited

OTHER PUBLICATIONS

International Search Report for PCT/ES2021/070429 dated Feb. 23, 2022.
Written Opinion for PCT/ES2021/070429 dated Feb. 23, 2022.

* cited by examiner

PIN FOR COUPLING BETWEEN A WEAR ELEMENT AND A SUPPORT OF AN EARTH-MOVING MACHINE AND COUPLING SYSTEM

CROSS REFERENCE TO RELATED APPLICATIONS

This application is a National Stage of International Application No. PCT/ES2021/070429 filed Jun. 10, 2021.

OBJECT OF THE INVENTION

The present invention relates to a pin for coupling between a wear element and a support of an earth-moving machine and a coupling system comprising a wear element, a support to receive said wear element and a pin to secure retention between the wear element and the support thereof. Typically, the wear element will be a female part and the support will be a male part used in earth-moving machines such as excavators and the like. The female part has a cavity and can be a wear element, a tooth or an intermediate adapter (part arranged in a three-part system between a wear element or female part and a projection or male part) and the male part has a projection or nose that is inserted into the cavity of the female part. Said male part will normally be a tooth holder or adapter, an intermediate adapter, a cast lip nose or a weld nose.

The female part is coupled to the male part, these two parts being kept coupled by means of the pin of the present invention which comprises a body, an elastic block and a latch that acts as a retention element. The female part is detachably coupled to the male part and the position between the two is kept due to the insertion of the pin that interacts with the latch that locks the pin in position. Said pin prevents the female part from coming out of the mounting position thereof with the male part and therefore keeps the coupling between both parts. The detachable lock enables the pin to be removed from the coupling and the replacement of the female part and also of the pin, if required.

This invention can generally be applied to excavators and similar machines such as those used in public works, dredging and mining machines for pulling, moving and loading earth and stones.

DESCRIPTION OF THE STATE OF THE ART

Excavators and similar machines are usually provided with a ladle or bucket attached to a mechanical arm. The ladle or bucket is equipped with a blade or bevelled lip on a front edge intended to strike and penetrate the mass of earth and stones. To avoid excessive wear on the blade and to help penetrate the ground, it is common to mount wear elements with a wear tip and a cavity, preferably teeth (they can also be protective elements of the ladle) associated with the blade that emerge from the front portion thereof. However, such wear elements are also subject to wear and tear and must therefore be replaced frequently. Furthermore, depending on the work to be carried out by the machine, it may be desirable to change the type or shape of said wear elements. To facilitate said replacement, a support, adapter or tooth holder is used, which at one end is fixed to the blade of the ladle or bucket in a more or less permanent way, and at the opposite end it is coupled to the wear element in a removable way, fixing the position between both parts by means of a pin. Said pin usually passes through orifices in the wear element and a conduit that passes through the adapter element or tooth holder, so that the wear element is fixed or fastened to the adapter. Usually the wear element will be a female element, with a cavity into which the nose of the adapter element is inserted, which acts as a male element, however, it is also possible to have a reverse system, in which the wear element has a nose, acting as a male element, which is inserted into a cavity of the adapter element, the latter acting as a female element.

To prevent the pin from coming out of the mounting position thereof, a retention element or latch associated with the pin is sometimes used, which is responsible for locking the pin in the mounting position thereof, fastening the coupling between the wear element and the adapter and, therefore, fastening the mounting of the system or assembly. The pin may include, in addition to the latch, an elastic member to apply a thrust force to the latch. When coupling systems work under difficult conditions, due to these exertions the tooth tends to come out of the mounting position thereof, the pin is the one that keeps the wear element, or tooth, fixed to the adapter, or tooth holder, supporting all the stresses and it tends to move, come off and/or break due to said stresses. If this happens, both the pin and the wear element separating from the adapter may get lost. The loss of a wear element, mainly a tooth, can be very damaging depending on the workplace, not only due to the loss of time, but also because it can damage the adapter in addition to causing breakdowns in other machines, such as crushers, that can work in the same place of production as the machine that uses the teeth, such as, for example, in mines or quarries.

Several examples of pins can be seen in international application number WO2010089423A1 applied to a coupling system between a female part or wear element with a cavity and a male part or support with a projection or nose, such that said support or adapter has a concave recess in at least one of the surfaces of the nose and said wear element has a convex projection in at least one of the surfaces that make up the cavity, so that when the cavity of the tooth is inserted into the projection of the tooth holder, the recess and the projection are aligned determining a curved cavity into which the pin is inserted.

The present invention therefore describes an alternative pin to those described in the aforementioned document and applicable to the coupling systems between the wear element and the support or adapter described in said document. The pin object of the present invention has the particularity of facilitating the insertion, extraction and retention of the pin in the cavity between the wear element and the support or adapter. Likewise, the invention relates to a coupling system that incorporates the pin that is the object of the present invention.

DESCRIPTION OF THE INVENTION

A first object of the present invention is a pin for coupling between a wear element, and a support or adapter, of an earth-moving machine according to claim 1.

Specifically, the pin has an elongated body with two curved surfaces, a concave upper surface and a convex lower surface, the upper surface having an upper orifice for access to a cavity inside the body and an elastic block arranged inside the cavity of the body with an upper surface, and further having a latch, or retention element, partially housed in the cavity of the body, said latch having a body with:

A curved outer surface,

An upper surface and a lower surface, connected to each other by the curved outer surface, and the lower surface being in contact with the upper surface of the elastic block and the upper surface located between the curved outer surface and the intermediate surface, A partially curved intermediate surface, opposite the outer surface and after the upper surface, Two flat side surfaces, and A cylinder by way of rotation shaft of the latch, arranged between the intermediate surface and the lower surface, the ends of the cylinder extending beyond the flat side surfaces of the latch.

The latch and elastic block make up a retention system or assembly.

The pin is inserted into the gap or space formed between the wear element and the support or adapter element in the direction of the coupling between the two, as described in the publication WO2010089423A1, such that the locking planes of the pin with the tooth absorb or minimise and compensate the ejection forces due to the reactions of the exertions received, thus reducing the breakage thereof. After the insertion thereof, the pin comes into contact with the wear element, preventing it from coming out of the coupling position thereof with the support or adapter. The pin locks the wear element and prevents it from coming out.

Specifically, the wear element comprises a cavity opposite the wear tip, with four inner walls that define the coupling area to be coupled to the nose of the support or male part, and said cavity having at least one convex projection or protrusion towards the inside of the cavity. Moreover, the support comprises, as mentioned, a nose as a coupling area to be coupled to the wear element when being inserted into the inner walls of said cavity, and said nose having at least one concave recess in at least one of the surfaces thereof. After the wear element and the support are coupled, the convex protrusion of the first is facing the concave recess of the second, leaving a space or gap between said convex surface of the protrusion of the wear element and the concave recess of the support. Said female and male elements are preferably coupled in a coupling direction with a curved motion therebetween to house the nose inside the cavity. Although the description of the present invention relates to a system formed by a wear element and a support or adapter element such as those described, it is possible that the system is inverted, in other words, the wear element incorporates a nose instead of a cavity and the support or adapter element is the one that has a cavity.

Once the wear element and the support are coupled, by inserting the cavity of the wear element into the projection or nose of the support, the pin is inserted between both of them, through an opening or orifice made in one of the surfaces of the wear element and that connects the space or gap between said wear element and the support with the outside.

The main body of the pin has an elongated, slightly curved shape and rounded corners. The pin preferably has six surfaces, the side walls thereof being able to be parallel to each other or not. In the event that they are not parallel, said walls converge at a front end towards the same point, determining a wedge that is sectioned at the front portion or first end thereof.

The upper face of said body of the pin has, generally and almost along the entire length thereof, a curvature complementary to the convex inner surface of the protrusion of the wear element and the lower surface of said body of the pin has a curvature complementary to the concave surface of the cavity, recess or slot of the adapter element or tooth holder. In this way, when the main body of the pin is inserted into the gap or space between the wear element and the support through the orifice of the wear element, also by means of a curved movement, the upper surface of the pin makes contact with the surface of the protrusion of the wear element, thus making up an opposition area in addition to completing the mounting of the system.

As mentioned, the pin also has, partially inserted into the body thereof, specifically in an internal cavity of the body which is accessed through an upper orifice, a retention system formed by a latch or retention element and at least one elastic block. The objective of this retention system and especially of the latch is to prevent the main body of the fastening system or pin from coming out of the mounting position thereof when working, in other words, to lock the pin in the gap between the wear element and the adapter or support. This latch is preferably metallic and is associated to said elastic block arranged below the latch, such that the latch is located between the elastic block and the body of the pin. The elastic block of the retention system, capable of being compressed, enables the latch to be inserted inside the body during the insertion of the pin between the wear element and the support, by compressing due to the pressure exerted by the protrusion of the wear element on the latch, thus enabling the latch to overcome the protrusion. After passing by this protrusion, the elastic block relaxes and pushes the latch so that it protrudes again from the cavity of the body of the pin, blocking the exit of the pin from the space between the wear element and the support and securing the mounting position of the pin. To extract the pin, it is necessary to push the latch against the elastic block, compressing it, and then push the pin in the opposite direction to that of insertion thereof between the wear element and the support.

Next, the pin will be described in detail with reference to the three components thereof, the body, the latch and the elastic block, the latter two making up the retention system.

The body of the pin is an elongated body with two curved surfaces, the concave upper surface and the convex lower surface thereof. The side walls of the body of the pin can be parallel or have a certain convergence towards one end, such that one end of the body is wider than the opposite end. The body of the pin also has a cavity therein which is accessed through an upper orifice arranged in the upper surface of the body. Alternatively, the body may have a lower orifice in the lower surface thereof through which the inner cavity of the body is also accessed. The inner cavity of the body of the pin has respective guides on the side walls thereof, inside of which the latch of the pin fits.

As mentioned, said latch has a body with a curved outer surface that acts as a retention wall, a partially curved intermediate surface, two flat side surfaces, an upper surface and a lower surface, preferably flat, and a cylinder by way of rotation shaft of the latch, arranged between the intermediate surface and the lower surface, the ends of the cylinder extending beyond the flat side surfaces of the latch. Preferably, the latch is inserted into the body of the pin through the lower orifice, inserting the ends of the cylinder into the guides of the cavity, preventing the latch from coming out of the body of the pin. Said guides describe a trajectory inside the cavity to move the latch from the lower orifice to a final housing. In this last position, the latch has a portion inside the body and a portion, mainly the outer surface or retention wall thereof, outside the body. Likewise, the upper surface of the latch has a slot to receive a tool, preferably a flat screwdriver, which facilitates the application of a thrust force on the latch to move it from the locked position to the unlocked position and to be able to remove the pin.

The elastic block is arranged, as mentioned, below the latch, and the main function thereof is to keep the outer surface of the latch outside the body of the pin as well as enabling the latch to be inserted inside the cavity to save the protrusion from the wear element. Said elastic block has an upper surface, preferably flat, on which the lower surface of the latch rests. The elastic block has a first compressible block of cellular polyurethane (it enables compression without expanding the cross section thereof) and can optionally have a second block, made of polyurethane with greater rigidity than that of the first block located adjacent to said first block, being able to be attached or not. Said second block is hardly compressible compared to the first block.

In the event that the elastic block has said second elastic block, it is located flush with the lower surface of the pin. This second block is denser than the material of the first block such that when inserting the pin with this second elastic block into the cavity of the adapter, the second block facilitates sliding, since by being a material with more hardness it enables friction between the convex lower surface of the body of the pin and the concave surface of the recess of the adapter. If the material of the second block were the same as that of the first block, in other words, cellular polyurethane, this would slow down the insertion of the body of the pin since the friction coefficient is higher in cellular polyurethane.

Preferably, the first polyurethane is cellular and has a density of 0.55 g/cm$^3$ (according to DIN EN ISO 845) and an elongation at break (according to DIN ISO 1798) of 450%. It is preferably Cellasto (registered trademark of BASF). Regarding the second block, it is non-cellular polyurethane, with a hardness of between 70 and 95 Shore A, preferably 95 Shore A.

By inserting the pin into the space between the wear element and the support through the orifice in the wear element, for the mounting position thereof, the latch is pushed by the protrusion of the wear element into the body, compressing the first elastic block that due to the properties thereof is compressed without increasing the cross section thereof. Once said protrusion is overcome, the latch is released and comes out from inside the body of the pin, pushed by the decompression of the elastic block. The elastic block has to enable, with the compression thereof, the latch to be inserted inside the body of the pin and then to come out to the mentioned retention position with the wear element. In other words, it must enable the latch to enter inside the body of the pin during the insertion of the pin into the space between the wear element and the support.

To remove the wear element from the support, the pin must be removed, first acting on the latch to be able to release it. To do this, pressure must be applied against the latch, preferably with a standard tool, for example, a screwdriver, inserting it back into the body of the pin and pushing the pin towards the orifice of the wear element through which it was inserted into the space between the wear element and the support. A leverage action on the pin is combined with the force of pressure on the latch to remove the pin from said space. The compression of the elastic block enables the latch to come out of the intersection position thereof between the outer surface of the latch, or retention wall, and the protrusion of the wear element.

During operation, the surfaces of the retainer describe different trajectories, in particular the outer surface or retention wall and the surface of the cylinder or rotation or retention shaft. The trajectory of the retention wall and the trajectory of the retention shaft are non-concentric, thus enabling the height of the outer surface of the latch to be greater to achieve a greater retention height. This greater height helps to prevent the latch from being able to descend in the case of impact with the tooth with the consequent risk of losing the pin and decoupling between the wear element and the support.

A second object of the invention is a coupling system between a wear element with a cavity and a support with a nose of an earth-moving machine, said support comprising a convex recess in at least one of the surfaces of the nose and said wear element comprising a concave projection in at least one of the surfaces that make up the cavity, such that when the nose is inserted into the cavity, the recess and the projection are aligned determining a space or gap between the two in which a pin with the above features is inserted.

The pin is preferably located in the upper locking configuration, in other words, the pin is inserted into the space created between the upper surface of the support and the upper surface of the wear element, thus facilitating access during mounting and dismounting of the system, although other configurations are possible if the space is created between the lower or side surfaces. Said pin may be centred on said upper surface or on one side thereof. Likewise, and if the terrain and machine conditions require it, it would be possible to arrange two pins, an upper one and a lower one, or two fastening systems on the same surface.

Once the wear element is coupled to the support and when normal force is applied in the longitudinal direction when the machine performs operations and backward movement, the wear element does not come out of the support because the locking planes of both elements are opposed, thus compensating the ejection forces to which the wear element is subjected in traditional fits.

For high productivity applications (mines and large quarries) where the terrain is extremely abrasive, a three-part system is provided, in other words, a first support, adapter element or tooth holder; a second support, intermediate wear element or intermediate adapter; and a replaceable tip or wear element. The fit between the second support and the wear element will be the same as that between the first support and the second support with a configuration suited to the geometry (normally it will compress in length) to enable a replaceable fit at the tip of the wear element.

It is understood that the description given of the coupling areas of the wear element and the support includes modifications that are obvious to a person skilled in the art, such that the nose positioned on the support is located on the wear element and the cavity of the wear element is located in the support, the inversion of the system depending on the specific working conditions.

In the present description, an element is considered to be concave when in mounting or operating position it has a curved cavity or recess (bulge), whereas it is considered convex when in mounting or operating position it has a curved projection or ledge.

DESCRIPTION OF PREFERRED EMBODIMENTS

Figure 1:
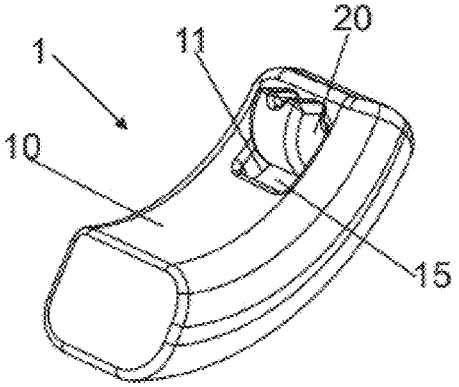
FIG. 1 shows a perspective view of a first exemplary embodiment of a pin according to the present invention.
Figure 2:
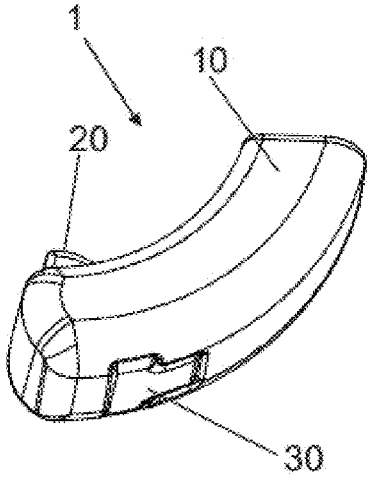
FIG. 2 shows a second perspective view of the pin of FIG. 1.

Various exemplary embodiments of the invention will be described below with reference to the previous figures.

FIGS. 1 to 5 show a first exemplary embodiment of a pin (1), according to the present invention, to secure a mounting position between a wear element (50) and a support or adapter (60). Said pin (1) comprises an elongated body (10) with two curved surfaces, a concave upper surface (12) and a convex lower surface (13). On said upper surface there is an upper orifice (11) for access to a cavity (15) inside the body (10). Inside said cavity (15) there is an elastic block (30) and on the same, supported on an upper surface (33) thereof, preferably flat, a latch (20) that is partially housed in the cavity of the body (10). Said latch (20) protrudes from said cavity (15) except when pressure is exerted on the same such that the elastic block (30) is compressed and said latch is inserted inside said cavity (15).

The elastic block (30) is inserted inside the body of the pin (10) either through a lower orifice (18) (FIGS. 1 to 9) or through the upper orifice (110) in a body of the pin (100) of a second alternative exemplary embodiment (100) (FIGS. 10 to 13).

The body of the pin (10, 100) shown in the figures has the two side walls thereof parallel, but they could be non-parallel to each other, such that they converge at one end of the body of the pin towards the same point, determining a wedge sectioned at said end.

Figure 3:
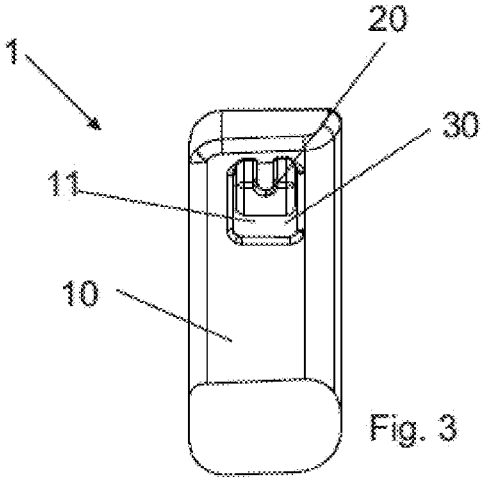
FIG. 3 shows a plan view of a pin of FIG. 1.
Figure 4:
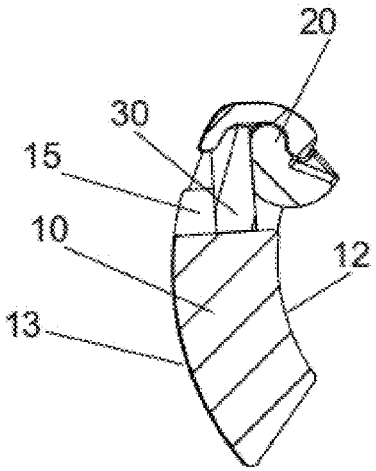
FIG. 4 shows a longitudinal cross section of the pin of FIG. 1.
Figure 5:
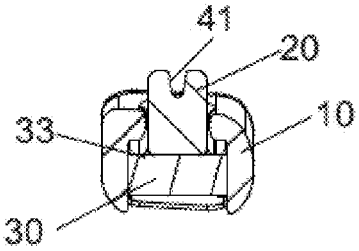
FIG. 5 shows a cross section of the pin of FIG. 1.
Figure 6:
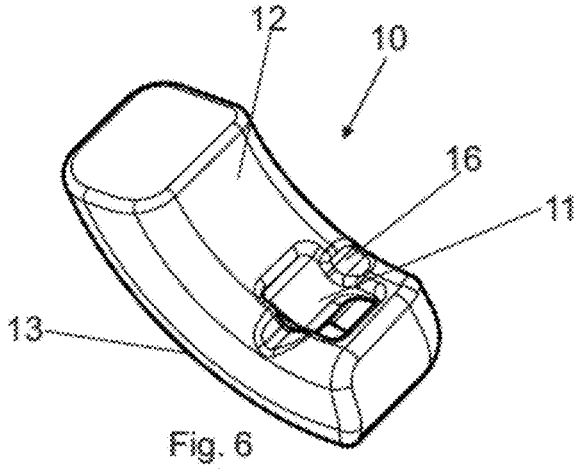
FIG. 6 shows a perspective view of the body of the pin of FIG. 1.

FIGS. 6 to 9 show the body of the pin (10) of said first exemplary embodiment. Said body of the pin (10) has on the upper surface (12) thereof the upper orifice (11) that enables access to the cavity (15) of the body of the pin (10). Said upper surface (12) can optionally have (see FIGS. 6, 7 and 8), on both sides of the upper orifice (12), a slot (16) the function of which is to act as support for a tool, preferably a flat screwdriver, to push the body of the pin (10) in a direction, specifically, from a mounting position of the pin (1) to a dismounting position between the wear element (50) and the support (60). FIGS. 1 and 3 show a body of the pin (10) without said slots on the upper surface (12) thereof.

Figure 7:
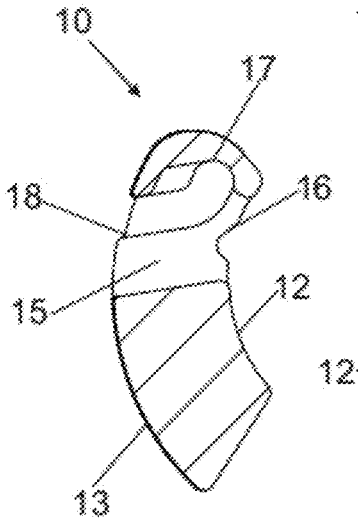
FIG. 7 shows a longitudinal cross section of the body of the pin of FIG. 1.
Figure 8:
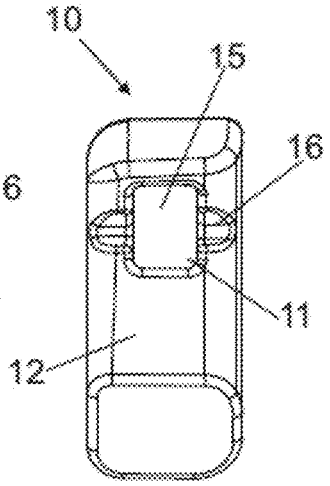
FIG. 8 shows a top elevation view of the body of the pin of FIG. 1.
Figure 9:
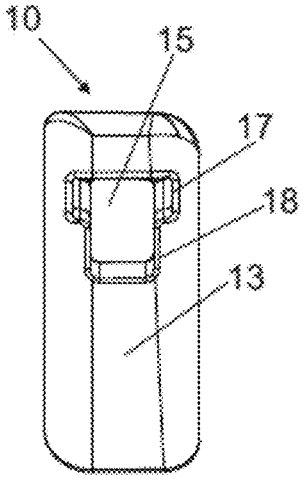
FIG. 9 shows a lower elevation view of the body of the pin of FIG. 1.
Figure 10:
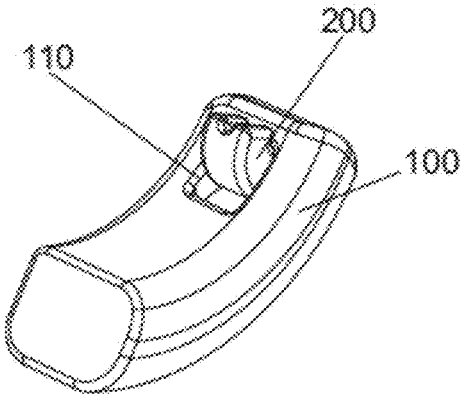
FIG. 10 shows a perspective view of a second exemplary embodiment of a pin according to the present invention.
Figure 11:
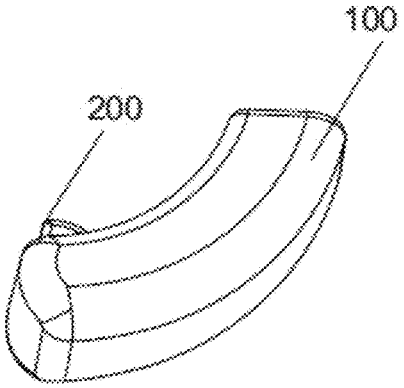
FIG. 11 shows a second perspective view of the pin of FIG. 10.
Figure 12:
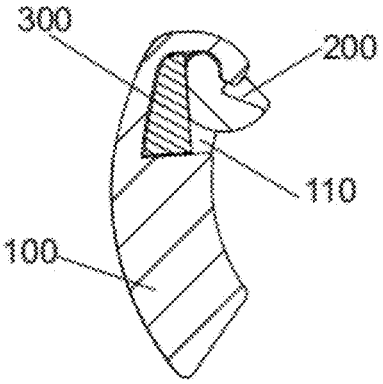
FIG. 12 shows a longitudinal cross section of the pin of FIG. 10.
Figure 13:
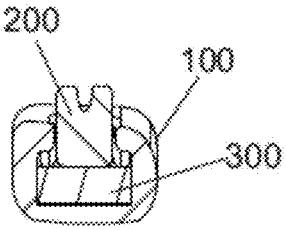
FIG. 13 shows a cross section of the pin of FIG. 10.
Figure 14:
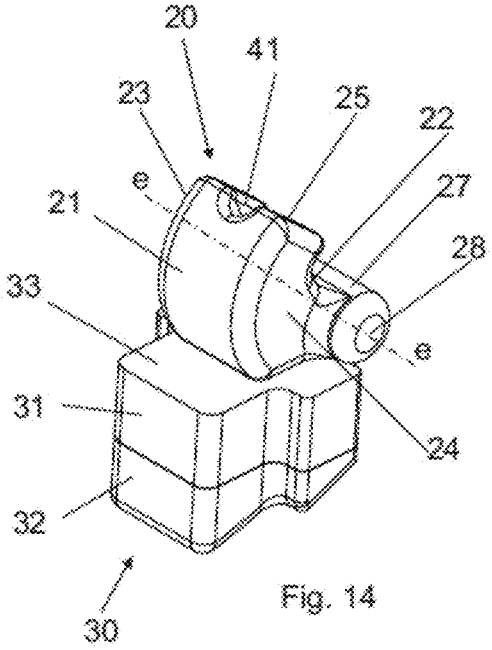
FIG. 14 shows a perspective detailed view of the retention assembly or system formed by the latch and the elastic block.
Figure 15:
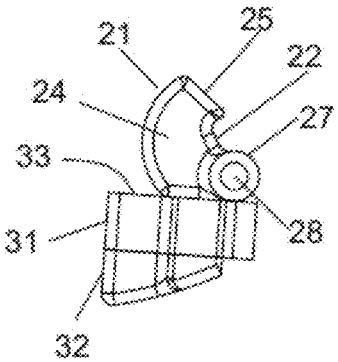
FIG. 15 shows a side view of the system of FIG. 14.
Figure 16:
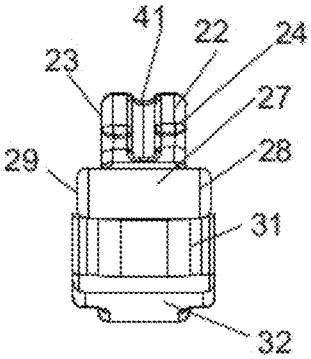
FIG. 16 shows a plan view of the system of FIG. 14.
Figure 17:
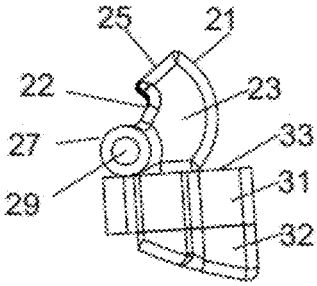
FIG. 17 shows a side view of the system of FIG. 14.

The lower orifice (18) of the body of the pin (10) gives access to the inner cavity (15) of the body of the pin (10) as well as to respective guides (17) made inside the facing walls of the body of the pin (10). Said guides (17) are open at the end of the lower orifice (18) and closed at the opposite end thereof (FIG. 7). The latch (20) of the pin (1) will be fitted and guided in said guides (17). Due to the arrangement of the guides (17), the lower orifice (18) has a T-shape (FIG. 9).

In this way, the mounting of the latch (20) in the body of the pin (10) according to the first embodiment is performed by first inserting the latch (20) through the lower orifice (18) into the inner cavity (15) and then closing said lower orifice (18) with the insertion of the elastic block (30) into the cavity (15).

Alternatively, the body of the pin (100) of the second exemplary embodiment does not have, as mentioned above, a lower orifice, such that both the elastic block (300) and the latch (200) are inserted into the cavity (150) through the upper orifice (110) as seen in FIGS. 10 to 13.

Figure 18:
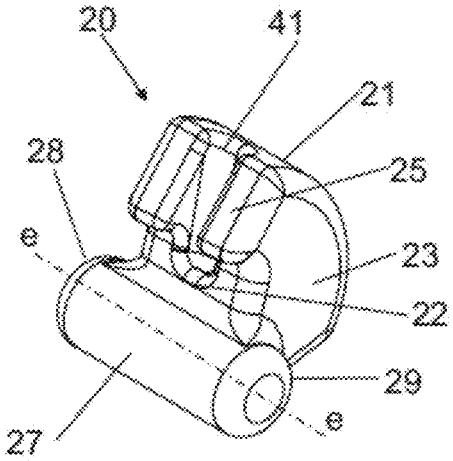
FIG. 18 shows an upper perspective view of the latch.
Figure 19:
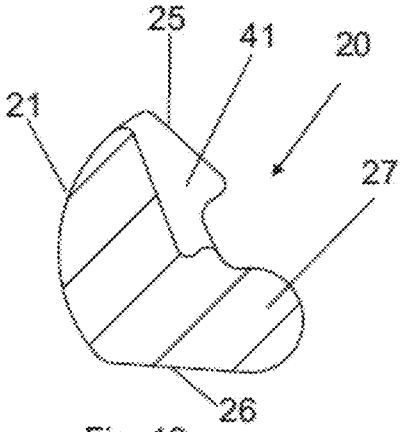
FIG. 19 shows a cross section of the latch of FIG. 18.
Figure 20:
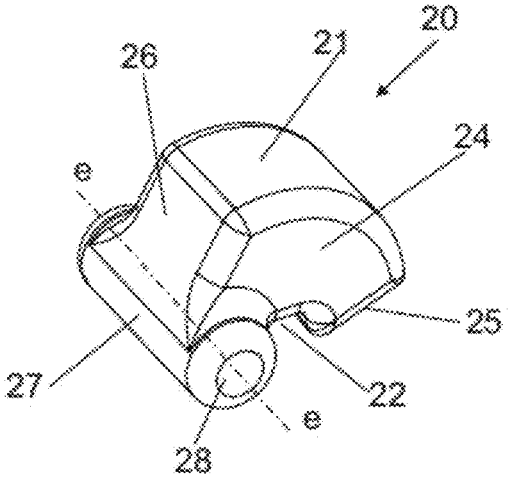
FIG. 20 shows a lower perspective view of the latch.

FIGS. 18 to 20 show a detailed view of the latch (20) that is part of the pin (1) object of the present invention and that is inserted into the body of the pin. The latch (20) has:

- A curved outer surface (21),
- An upper surface (25) and a lower surface (26), connected by the curved outer surface (21), such that the lower surface (26) is in contact with the upper surface (33) of the elastic block (30) when the latch (20) and the elastic block (30) are positioned inside the cavity (15),
- A partially curved intermediate surface (22) opposite the outer surface (21) and after the upper surface (25),
- Two flat and parallel side surfaces (23, 24), and
- A cylinder (27) by way of rotation shaft of the latch (20), which is located between the intermediate surface (22) and the lower surface (26), the ends (28, 29) thereof extending beyond the flat side surfaces (23, 24) of the latch (20).

The latch (20) is inserted into the body of the pin (10) of the first embodiment through the lower orifice (18), specifically by inserting the ends (28, 29) of the cylinder (27) of said latch (20) into the guides (17) of the body of the pin (10). Once the ends (28, 29) have reached the end of said guides (17), the latch (20) will be able to rotate about an axis "e" determined by said cylinder (27).

The upper surface (25) of the latch (20) has a slot (41) so that a conventional tool, preferably a flat-tip screwdriver, can be inserted into the same and exert pressure on the latch (20) to force its insertion into the inner cavity (15) compressing the elastic block (30).

FIGS. 14 to 17 show the assembly formed by the latch (20) and the elastic block (30) isolated from the body of the pin (1) for a better view of said assembly. In this embodiment, the elastic block (30) is preferably formed by a first compressible block (31) made of cellular polyurethane, with a density of 0.55 g/cm$^3$ (according to DIN EN ISO 845) and a second block (32), preferably made of non-cellular polyurethane, barely compressible compared to the first block (31), in other words, more rigid with a hardness of approximately 95 Shore A. This second block (32) is less compressible than the first elastic block (31), and is arranged below the first block (31) without protruding through the lower orifice (18) of the body (10), flush with the convex lower surface (13) of the body of the pin (10). Since the material of the second block (32) is harder than the material of the first block when inserting the pin (10) into the cavity of the adapter (60), the second block (32) rubs with the concave surface of said cavity of the adapter (80). The upper surface (33) of the first block (31) is flat so that the lower surface (26) of the latch, which preferably will also be flat, is supported thereon. Said first block (31) is preferably Cellasto (registered trademark of BASF).

The material of the second block is denser than the material of the first block such that when inserting the pin with the elastic block into the cavity of the adapter, it facilitates sliding. If the material of the second block were the same as the first material, in other words, cellular polyurethane, this would slow down the insertion of the body of the pin.

In the second exemplary embodiment of the pin shown in FIGS. 10 to 13, the elastic block (300) is only formed by a single block (300) of the same material as the first block (31) of the first exemplary embodiment. Specifically, a block (300) of cellular polyurethane with a density of 0.55 g/cm$^3$ (according to DIN EN ISO 845), preferably Cellasto (registered trademark of BASF).

Figure 21:
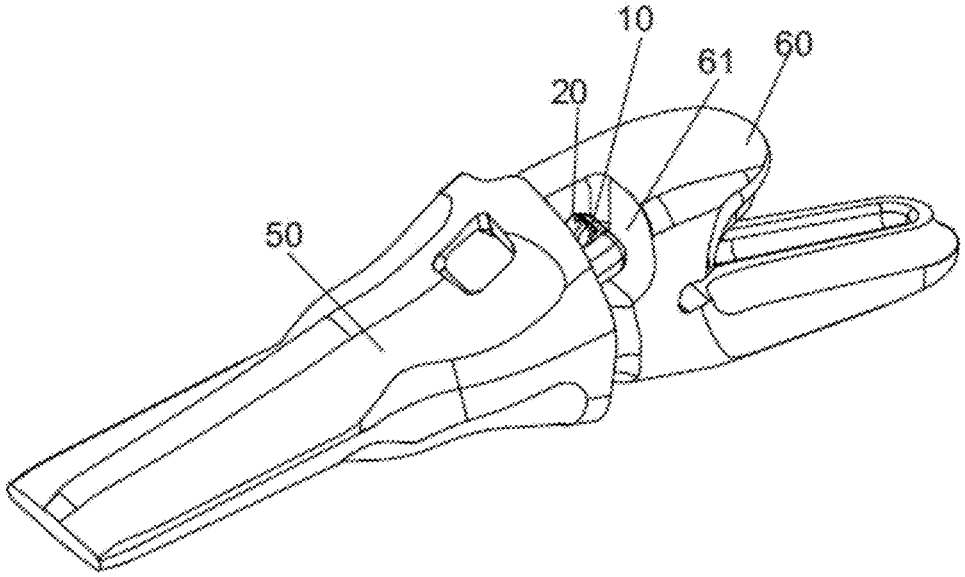
FIG. 21 shows a perspective view of a wear element coupled to a support with the orifice of the wear element and the space or gap of the support on one side of the upper surface thereof.
Figure 22:
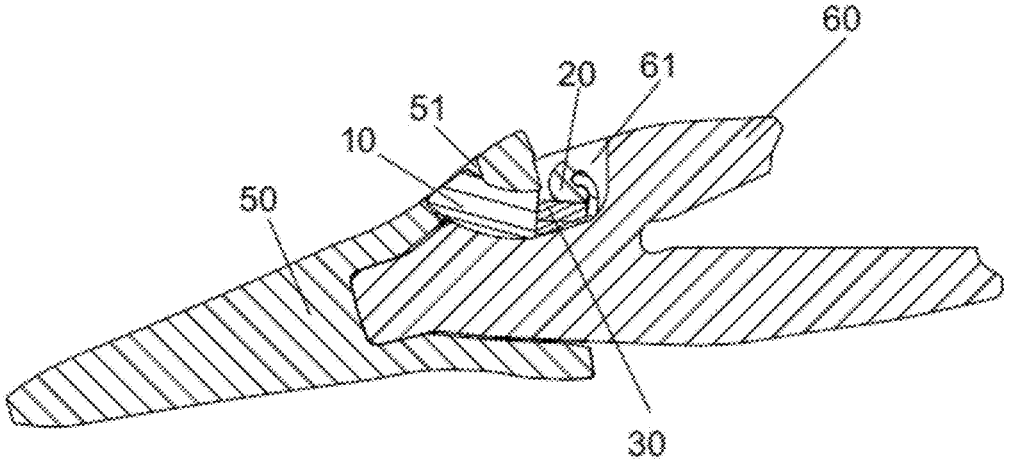
FIG. 22 shows a cross section of the coupling of the wear element and the support of FIG. 21.

For mounting the pin (1) in a coupling between a wear element (50) and a support or adapter (60) as shown in FIGS. 21 and 22, the pin (1) is inserted into a space formed between said wear element (50) and adapter (60) after inserting the nose of the adapter (60) into the cavity of the wear element (50). In the example of FIGS. 21 and 22, the orifice (51) and the gap (61) are on one side of the upper surface of the wear element (50) and of the support (60), respectively. In an alternative construction (not shown in the figures), the orifice and the gap are centred on the upper surface of the wear element and of the support, respectively.

Specifically, the wear element (50) comprises a cavity opposite the wear tip, with four inner walls that define the coupling area to be coupled to the nose of the adapter (60), and said cavity having at least one convex projection or protrusion towards the inside of the cavity. Moreover, the adapter (60) comprises the nose as a coupling area to be coupled to the wear element (50) when being inserted into the inner walls of said cavity, and said nose having at least one concave recess in at least one of the surfaces thereof, in the example, on the upper surface. After the wear element (50) and the adapter (60) are coupled, the convex protrusion of the first (50) is facing the concave recess of the second (60), leaving a space or gap (61) between said convex surface of the protrusion of the wear element (50) and the concave recess of the adapter (60).

Once the wear element (50) and the adapter (60) are coupled, the pin (1) is inserted between both of them, through an opening or orifice (51) made in one of the surfaces, in the example in the upper one, of the wear element (60) and that connects the space or gap (61) between said wear element (50) and the adapter (60) with the outside.

When inserting the pin (1) through the orifice (51) of the wear element (50), the latch (20) is pushed towards the inside of the cavity (15) of the body of the pin (10) by the convex protrusion of the wear element (50). The elastic block (30) enables the latch (20) to be inserted inside the body (15) by contracting due to the pressure exerted by the protrusion of the wear element (60) on the latch (20), thus enabling the latch (20) to overcome the protrusion. After passing by this protrusion, the elastic block (30) relaxes and pushes the latch (20) so that it protrudes again from the cavity (15) of the body (10) of the pin (1), blocking the exit of the pin (1) from the space (61) between the wear element (50) and the adapter (50), thus securing the mounting position of the pin (1). In this way the latch (20) interferes with the convex protrusion of the wear element (50) when it is located in said gap or space (61).

To extract the pin (1), it is necessary to push the latch (20) against the elastic block (30), compressing it, using a conventional tool, preferably a flat-tip screwdriver, which is inserted into the slot (41) of the upper surface (25) of the latch (20). Subsequently, with the same tool, the pin (1) is pushed, inserting the tip of the tool into the slots 16 of the body of the pin (10), in the opposite direction to that of insertion thereof between the wear element (50) and the adapter (60).

The invention claimed is:

1. A pin for coupling between a wear element and a support of an earth-moving machine, comprising:

an elongated body with two curved surfaces, a concave upper surface and a convex lower surface, the concave upper surface having an upper orifice for access to a cavity inside the body;

an elastic block arranged inside the cavity of the body with an upper surface; and a latch partially housed in the cavity of the body, said latch having:

a curved outer surface;

an upper surface and a lower surface, connected by the curved outer surface, the lower surface being in contact with the upper surface of the elastic block;

a partially curved intermediate surface opposite the outer surface and after the upper surface;

two flat side surfaces; and a cylinder configured as a rotation shaft of the latch about a rotation axis, the cylinder arranged between the intermediate surface and the lower surface, wherein ends of the cylinder extend axially along the rotation axis beyond the flat side surfaces of the latch.

2. The pin, according to claim 1, wherein the upper surface of the latch comprises a slot.

3. The pin, according to claim 1, wherein the elastic block has a first compressible block made of cellular polyurethane with a density of 0.55 g/cm$^3$.

4. The pin, according to claim 1, wherein the convex lower surface of the body comprises a lower orifice for access to the cavity of the body.

5. The pin, according to claim 4, wherein the elastic block comprises, in addition to the first block, a second rigid block of material barely compressible compared to the first elastic block arranged below the first block.

6. The pin, according to claim 5, wherein the second rigid block is polyurethane with a hardness between 70 and 95 Shore A.

7. The pin, according to claim 1, wherein the lower surface of the latch is flat.

8. The pin, according to claim 1, wherein the cavity of the body has a circular gap for housing the cylinder of the latch.

9. A coupling system between a wear element with a cavity and a support with a nose of an earth-moving machine, said support comprising a convex recess in at least one surface of the nose and said wear element comprising a concave projection in at least one surface of the cavity of the wear element, such that when the nose is inserted into the cavity, the recess and the projection are aligned, and wherein the coupling system comprises the pin according to claim 1 inserted into said cavity of the wear element.

10. A pin for coupling between a wear element and a support of an earth-moving machine, comprising:

an elongated body with two curved surfaces, a concave upper surface and a convex lower surface, the concave upper surface having an upper orifice for access to a cavity inside the body;

an elastic block arranged inside the cavity of the body with an upper surface; and a latch partially housed in the cavity of the body, said latch having:

a curved outer surface;

an upper surface and a lower surface, connected by the curved outer surface, the lower surface being in contact with the upper surface of the elastic block;

a partially curved intermediate surface opposite the outer surface and after the upper surface;

two flat side surfaces; and a cylinder configured as a rotation shaft of the latch, the cylinder arranged between the intermediate surface and the lower surface, the ends thereof extending beyond the flat side surfaces of the latch; and wherein the upper surface of the latch comprises a slot.

11. A pin for coupling between a wear element and a support of an earth-moving machine, comprising:

an elongated body with two curved surfaces, a concave upper surface and a convex lower surface, the concave upper surface having an upper orifice for access to a cavity inside the body;

an elastic block arranged inside the cavity of the body with an upper surface; and a latch partially housed in the cavity of the body, said latch having:

a curved outer surface;

an upper surface and a lower surface, connected by the curved outer surface, the lower surface being in contact with the upper surface of the elastic block;

a partially curved intermediate surface opposite the outer surface and after the upper surface;

two flat side surfaces; and a cylinder configured as a rotation shaft of the latch, the cylinder arranged between the intermediate surface and the lower surface, the ends thereof extending beyond the flat side surfaces of the latch; and wherein the convex lower surface of the body comprises a lower orifice for access to the cavity of the body.

* * * * *